United States Patent [19]

Imbery et al.

[11] Patent Number: 4,809,717

[45] Date of Patent: Mar. 7, 1989

[54] VENTILATED CIGARETTE

[75] Inventors: Dieter Imbery, Hartheim; Eberhard Teufel, Gundelfingen, both of Fed. Rep. of Germany

[73] Assignee: Rhodia AG, Freiburg im Breisgau, Fed. Rep. of Germany

[21] Appl. No.: 70,892

[22] Filed: Jul. 8, 1987

[30] Foreign Application Priority Data

Jul. 22, 1986 [DE] Fed. Rep. of Germany ..... 3624661

[51] Int. Cl.[4] ..... A24D 3/04

[52] U.S. Cl. ..... 131/332; 131/336; 131/345

[58] Field of Search ..... 131/332, 336, 345

[56] References Cited

U.S. PATENT DOCUMENTS 3,526,904 9/1970 Tamol .
3,756,250 9/1973 Morganstern ..... 131/336
4,059,121 11/1977 Brackmann et al. ..... 131/332

FOREIGN PATENT DOCUMENTS 2321247 4/1973 Fed. Rep. of Germany .
2745028 6/1977 Fed. Rep. of Germany .

OTHER PUBLICATIONS

Crellin, et al, The Control of Cigarette Smoke Deliveries Using Heat-Shrinkable Films-Contributions to Tobacco Research, vol. 8, p. 70 (1975).

*Primary Examiner*—V. Millin
*Attorney, Agent, or Firm*—Bucknam and Archer

[57] ABSTRACT

Ventilated cigarettes are made with a tip zone consisting of tobacco or a filter or a hollow tip, which contains, in the wrapper or wall, at least one ventilation zone. In the tip zone or between it and the tobacco roll, or in the latter, there is placed an element which consists of polymeric, not crimped spun fibers and/or filaments, which may have the shape of a disk. This element is arranged in such a manner that it is located behind the ventilation zone, when seen from the end of the tip zone facing the mouth. The spun fibers and filaments have, respectively, a diameter between 0.1 and 20 μm and lie generally transverse to the flow of the tobacco smoke. In contrast with the known ventilated cigarettes, the cigarettes according to the invention exhibit an equalization of the tobacco smoke yield during test smoking draw-by-draw, which keeps the smoke flavor during test smoking practically uniform and results in a lowering of the total smoke yield in the particle phase as well as in the gas phase per cigarette.

10 Claims, 4 Drawing Sheets

VENTILATED CIGARETTE

The present application is in accordance with Disclosure Document No. 155525 filed on Sept. 3, 1986.

This invention relates to ventilated cigarettes and more specifically to cigarettes which have a tip consisting of tobacco or a filter or a hollow piece and which contains in the wrapper or in the wall, at least one ventilation zone.

It is well-known from the results of draw-by-draw analyses with commercially available cigarettes which have a tip zone consisting of tobacco or a filter or a hollow piece that the tobacco smoke yield increases during test smoking from draw to draw. Among other consequences, this may result in a change in the flavor of the tobacco smoke with each draw. An equalization of the smoke yield per draw during test smoking thus is desirable, especially for the purpose of avoiding the change in flavor.

An equalization of the smoke yield from draw to draw is also desirable for the reason that a lowering of the total smoke yield is obtained in the particle phase as well as in the gas phase.

Studies for the solution of the problems mentioned hereinabove are found in the literature. In U.S. Pat. No. 3,526,904, a ventilated cigarette is described in which part of the ventilation zone at the tobacco roll is covered by a meltable polymeric film. After the polymeric film has melted, due to the adjacent, glowing zone, the ventilation of the roll is increased.

Crellin et al. also describe in "Contributions to Tobacco Research", 8: 70, 1975 a ventilated cigarette filter in which the filter end facing the tobacco is enveloped by a film which shrinks under the influence of heat. This foil produces an artificial collapse of the filter through which the draw resistance in the filter portion facing the tobacco is increased and an increase in the degree of ventilation is produced.

According to German Offenlegungsschrift No. 2745028, an increase in the degree of ventilation is obtained with a filter for tobacco smoking articles by providing a smoke accelerating opening located on the side of the tobacco.

The object of the present invention is to provide a ventilated cigarette which has a tip zone consisting of tobacco or a filter or a hollow tip with a degree of ventilation which increases during smoking to obtain an equalization of the smoke yield and flavor and to lower the total smoke values in the particle phase as well as in the gas phase.

This object is achieved with a ventilated cigarette of the type discussed hereinabove and with the novel features defined in the characterizing clause of claim 1.

Advantageous embodiments of the ventilated cigarette according to the invention are defined in claims 2, 3, 4 and 5.

A filter for tobacco smoke is described in the German Pat. No. 2321247, which is composed of several filter elements, at least one of which consists entirely of non-crimped fibers of thermoplastic, non-absorbent polymeric material. The fibers have a diameter of less than about 5 microns and the greater portion of the fibers is arranged in such a manner that the fibers are oriented transverse with respect to the stream of tobacco smoke. This known filter is not provided with a ventilation zone. This known filter also has the disadvantage that during the test smoking of a cigarette fitted with such a filter, the filter becomes clogged after a few draws because a large amount of condensate is very rapidly deposited on the filter element consisting of non-crimped fibers of the non-absorbent, thermoplastic polymeric material, a fact which increases the draw resistance excessively.

The filter element according to the invention may consist:

- of a mixture of spun fibers (staple fibers), i.e. fibers of finite length, and filaments, i.e. endless long threads, or
- only of spun fibers; or
- only of filaments.

The spun fibers and filaments according to the invention may consist of natural or synthetic, thermoplastic polymeric materials which may be processed into spun fibers and filaments with a diameter between 0.1 and 20 μm.

Examples of these materials are:

- polyolefins such as polypropylene and polyethylene, but also substituted polyolefins such as polytrifluoroethylene;
- polyamides such as nylon-66, nylon-6 and nylon 610;
- polyesters such as polyethylene terephthalate;
- poly-(methylmethacrylate);
- polystyrene;

mixtures of polymers or copolymers may also be used.

In general, the spun fibers and filaments of an element according to the invention consist of a single, i.e. the same polymeric material, but the element may also consist of a mixture of spun fibers and/or filaments of two or more polymeric materials.

The spun fibers and filaments of an element according to the invention can have the same diameter, but the spun fibers and filaments may also have different diameters.

Figure 2:
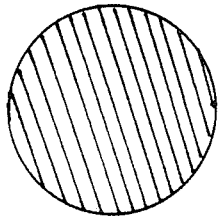
FIG. 2 is a view of the disk-shaped element along line A—A of FIG. 1.
Figure 1:
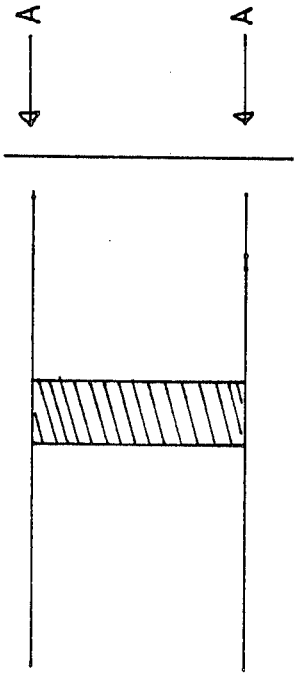
FIG. 1 is a schematic view in cross section of the element consisting of polymeric non-crimped spun fibers and/or filaments, in the shape of a disk.
Figure 4:
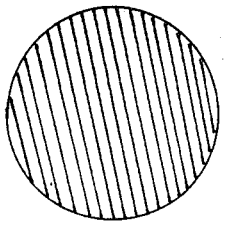
FIG. 4 is a view of the spherical element along line A—A of FIG. 3.
Figure 3:
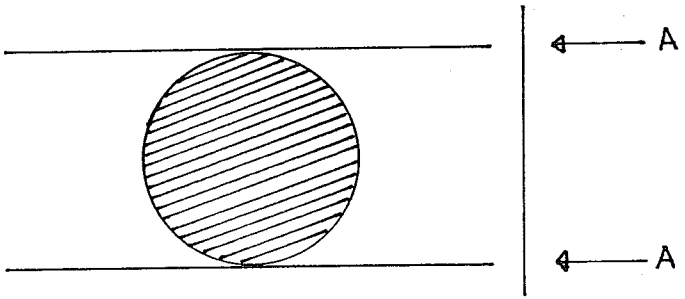
FIG. 3 is a schematic view in cross section of the element consisting of polymeric non-crimped spun fibers and/or filaments in the shape of a sphere.
Figure 6:
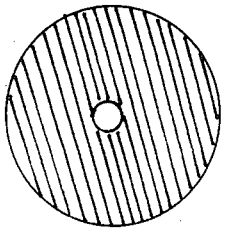
FIG. 6 is a view of the ring-shaped element along line A—A of FIG. 5.
Figure 5:
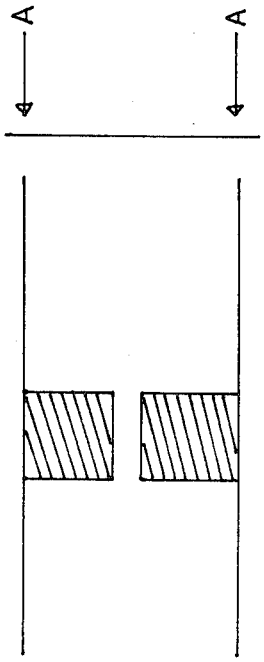
FIG. 5 is a schematic view in cross section of the element consisting of polymeric non-crimped spun fibers and/or filaments in the shape of a ring.
Figure 7:
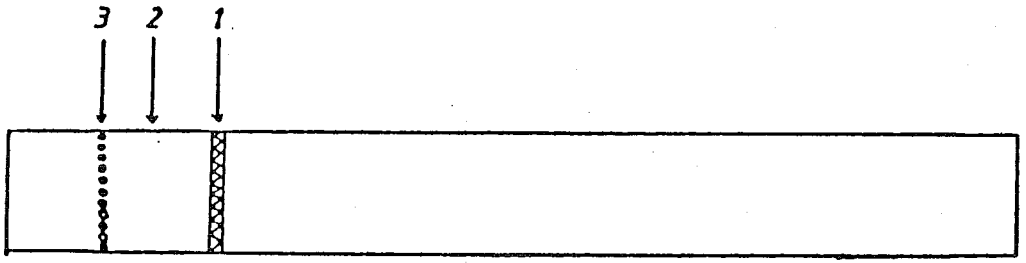
FIG. 7 is a schematic view in cross section of a ventilated cigarette according to our invention, the element consisting of polymeric non-crimped spun fibers and/or filaments in the case when the element has the shape of a disk.

In the figures, numeral 1 is the element consisting of polymeric non-crimped spun fibers and/or filaments; numeral 2 is the mouthpiece zone which may consist of tobacco or a filter and may be a hollow mouthpiece; and numeral 3 is the ventilation zone.

The invention is further illustrated by the following example.

EXAMPLE

Polypropylene with a melt index of 13 g/10 min. at 230° C., 2.16 kg., a density of 0.902 g/cm$^3$ at 23° C. and a melting range of 165°–170° C. was melted and was spun (extruded with air) into spun fibers and filaments by means of a spinneret similar to that described in German Pat. No. 2550463. The spun fibers and filaments were reformed into a spun fleece by depositing on a rotating drum.

The following spun fleeces were obtained in three trials by changing the spinning parameters, particularly the pressure of the air leaving the spinneret, which contributes to the formation and stretching of the spun fibers and filaments:

spun fleece A with a weight per square meter of 85 g and an air permeability of 65 l/min.cm$^2$ at 50 pascal (approx. 5 mm water column), consisting of spun fibers and filaments which had an average diameter of 2 μm;

spun fleece B with a weight per square meter of 85 g and an air permeability of 21 l/min.cm$^2$ at 50 pascal, consisting of spun fibers and filaments which had an average diameter of 1.4 μm;

spun feece C with a weight per square meter of 85 g and an air permeability of 202 l/min.cm$^2$ at 50 pascal, consisting of spun fibers and filaments of average diameter of 4.8 μm.

Round disks with a diameter corresponding to the diameter of the tobacco roll and the filter body of a commercially available filter cigarette—with a ventilation zone in the wrapper of the filter body—were punched from the spun fleeces A, B and C, respectively.

The disks, called disks A, B and C, after the spun fleeces from which they were made, were inserted in the ventilated filter cigarettes described hereinabove between the tobacco roll and the filter body, which consisted of the conventional crimped cellulose-2,5-acetate fibers. It is understood that the customary wrapper was placed after this step, to produce the filter cigarettes A, B and C. The spun fibers and filaments of the disks were arranged mainly transverse to the flow of the tobacco smoke.

Due to the insertion of the disks and depending on the air permeability of the disks, the initial draw resistance and thus the initial degree of ventilation of the filter cigarettes A, B and C rise slightly above that of the original filter cigarette, as shown in Table 1 below:

TABLE 1

| | Initial draw resistance in pascal | Initial ventilation degree in percent |
|---|---|---|
| Original filter cigarette | 955 | 14.7 |
| Filter cigarette A | 1298 | 23.7 |
| Filter cigarette B | 1692 | 32.3 |
| Filter cigarette C | 1028 | 17.5 |

Measurements were made to the degree of ventilation and draw resistance during smoking of the cigarettes mentioned above, i.e. the original filter cigarette and the filter cigarettes A, B and C. The measurements were obtained with a measuring device which allows the determination of the draw resistance and the degree of ventilation draw-by-draw under CORESTA norm conditions (CORESTA means Center of Cooperation for Scientific Tobacco Research).

The curves of draw resistance during smoking have been described by R. R. Baker in Contributions to Tobacco Research, 8: 124, 1975, where the principle of the "hot gas model" is also theoretically calculated. The measured values determined in this example for the original filter cigarette follow this model and a similar shape of the degree of ventilation curve has been found. Table 2 hereinbelow shows the values of the degree of ventilation and draw resistance of the original filter cigarette determined during smoking.

TABLE 2

| Draw | Degree of ventilation in percent | Draw resistance in pascal |
|---|---|---|
| 0 | 14.7 | 955 |
| 1 | 17.3 | 1068 |
| 2 | 18.9 | 1163 |
| 3 | 18.2 | 1159 |
| 4 | 17.2 | 1144 |
| 5 | 16.0 | 1114 |
| 6 | 15.1 | 1104 |
| 7 | 15.2 | 1151 |
| 8 | 15.1 | 1178 |
| 9 | 16.3 | 1203 |

Table 3 shows the values of the degree of ventilation and the draw resistance determined for the filter cigarette C during smoking.

TABLE 3

| Draw | Degree of ventilation in percent | Draw resistance in pascal |
|---|---|---|
| 0 | 17.5 | 1028 |
| 1 | 20.0 | 1125 |
| 2 | 22.4 | 1241 |
| 3 | 21.8 | 1226 |
| 4 | 21.7 | 1230 |
| 5 | 20.6 | 1213 |
| 6 | 19.9 | 1200 |
| 7 | 20.5 | 1255 |
| 8 | 19.9 | 1246 |
| 9 | 21.9 | 1376 |

It is clear from Tables 2 and 3 that the degree of ventilation of the original filter cigarette rises only by about 11% up to the ninth draw, while the degree of ventilation of the filter cigarette C rises by about 25%. This fact in the final analysis results in an equalization of the tobacco smoke yield per draw and thus also to a lowering of the total smoke yield in the particle phase as well as in the gas phase.

Table 4 below shows the values for the degree of ventilation and the draw resistance determined for the filter cigarette A during smoking.

TABLE 4

| Draw | Degree of ventilation in percent | Draw resistance in pascal |
|---|---|---|
| 0 | 23.7 | 1298 |
| 1 | 26.7 | 1437 |
| 2 | 30.1 | 1604 |
| 3 | 30.0 | 1624 |
| 4 | 30.6 | 1676 |
| 5 | 31.6 | 1767 |
| 6 | 32.3 | 1862 |
| 7 | 34.5 | 2029 |
| 8 | 37.3 | 2267 |
| 9 | 43.0 | 2609 |

Table 5 below shows the values for the degree of ventilation and the draw resistance determined for filter cigarette B during smoking.

TABLE 5

| Draw | Degree of ventilation in percent | Draw resistance in pascal |
|---|---|---|
| 0 | 32.3 | 1692 |
| 1 | 34.5 | 1809 |
| 2 | 37.8 | 1991 |
| 3 | 39.1 | 2061 |
| 4 | 41.2 | 2184 |
| 5 | 43.5 | 2325 |

TABLE 5-continued

| Draw | Degree of ventilation in percent | Draw resistance in pascal |
|---|---|---|
| 6 | 47.2 | 2557 |
| 7 | 53.2 | 2945 |
| 8 | 64.4 | 3695 |
| 9 | 74.3 | 4277 |

As clearly shown in Tables 4 and 5, a very definite increase in the degree of ventilation during smoking is obtained with disks A and B in the ventilated filter cigarettes, which naturally results in a very strong equalization of the smoke yield per draw and in a lowering of the total smoke yield per cigarette.

Finally, draw-by-draw smoke analyses under CORESTA norm conditions were also carried out with the original filter cigarette and filter cigarettes A and B. As shown in Tables 6, 7 and 8 and as was to be expected on the basis of the degree of ventilation measurements, a distinct equalization of the amount of tobacco smoke formed draw-by-draw and therefore a very strong lowering of the total smoke yield per cigarette are obtained with filter cigarettes A and B, in contrast with the original filter cigarette.

TABLE 6

| | Original filter cigarette | |
|---|---|---|
| Draw | Nicotine in the tobacco smoke in mg | Total condensate in the tobacco smoke in mg |
| 1 | 0.047 | 0.83 |
| 2 | 0.082 | 1.61 |
| 3 | 0.104 | 1.67 |
| 4 | 0.121 | 1.82 |
| 5 | 0.131 | 2.02 |
| 6 | 0.134 | 2.16 |
| 7 | 0.145 | 2.32 |
| { per cigarette | 0.764 | 12.43 |

TABLE 7

| | Filter cigarette A | |
|---|---|---|
| Draw | Nicotine in the tobacco smoke in mg | Total condensate in the tobacco smoke in mg |
| 1 | 0.030 | 0.59 |
| 2 | 0.053 | 0.82 |
| 3 | 0.069 | 1.01 |
| 4 | 0.076 | 1.15 |
| 5 | 0.087 | 1.27 |
| 6 | 0.091 | 1.36 |
| 7 | 0.100 | 1.61 |
| { per cigarette | 0.506 | 7.81 |

TABLE 8

| Draw | Nicotine in the tobacco smoke in mg | Total condensate in the tobacco smoke in mg |
|---|---|---|
| 1 | 0.018 | 0.36 |
| 2 | 0.030 | 0.46 |
| 3 | 0.036 | 0.56 |
| 4 | 0.043 | 0.61 |
| 5 | 0.045 | 0.66 |
| 6 | 0.047 | 0.69 |
| 7 | 0.050 | 0.78 |
| { per cigarette | 0.269 | 4.12 |

The invention offers the following advantages: The cigarette ventilated according to the invention shows —in contrast with commercially available ventilated cigarettes—an equalization of the smoke yield during test smoking draw-by-draw, which keeps the flavor of the tobacco smoke practically uniform during test smoking. In addition, this results also in a lowering of the total smoke yield in the particle as well as in the gas phase per cigarette.

What is claimed is:

1. A ventilated cigarette consisting of:

(1) a tobacco portion intended to be ignited during smoking, said tobacco portion having an upstream end and a downstream end;

(2) a mouthpiece having one end facing said downstream end of said tobacco portion, an opposite end which faces the mouth and a wrapper, said mouthpiece consisting of tobacco or a filter or a hollow portion;

(3) a ventilation zone located in the wrapper of said mouthpiece; and (4) an element consisting of non-crimped spun fibers and/or filaments, said element being located in said mouthpiece or between said mouthpiece and said downstream end of said tobacco portion intended to be ignited during smoking and behind the ventilation zone when seen from the opposite end of said mouthpiece, said spun fibers and/or filaments being arranged transverse to the flow of the tobacco smoke and having a diameter between 0.1 and 20 μm, said element having an air permeability of 21 l./min.cm$^2$—202 l.min. cm$^2$ at 50 pascals.

2. The cigarette according to claim 1 wherein said filter is made of crimped cellulose diacetate fibers.

3. The cigarette according to claim 1 wherein the element has the shape of a disk, a sphere or a ring.

4. The cigarette according to claim 1 wherein the element fills the cross section of the mouthpiece partially or completely.

5. The cigarette according to claim 1 wherein said element is located at a distance of up to 30 mm from said opposite end of the mouthpiece facing the mouth.

6. The ventilated cigarette according to claim 1 wherein the spun fibers and filaments have, a diameter between 1 and 5 μm.

7. The cigarette according to claim 1 wherein said element consists of natural or synthetic thermoplastic polymeric fibers.

8. The cigarette according to claim 7 wherein the fibers of said element are made of polypropylene, polyethylene, polytrifluoroethylene, a polyamide, a polyester, or mixtures or copolymers thereof.

9. The cigarette according to claim 8 wherein said polyester is polymethylmethacrylate.

10. The cigarette according to claim 1 wherein the element is a disk made of a polypropylene spun fleece of 85 g per square meters, air permeability of 21 l/min.cm$^2$ at 50 pascals, and the cigarette exhibits an initial draw resistance of 1692, initial ventilation degree of 32.3%, and the degree of ventilation is 74.3% and the draw resistance in pascals is 4277 after a total of nine puffs.

* * * * *